US005586683A

United States Patent [19]

Murakami

[11] Patent Number: 5,586,683

[45] Date of Patent: Dec. 24, 1996

[54] STORAGE DEVICE FOR UMBRELLA SACKS

[75] Inventor: Toshiyuki Murakami, Kanagawa, Japan

[73] Assignees: Kabushiki Kaisha Muraharu Seisakusho, Sagamihara; Niikura Scales Co., Ltd.; Kabushiki Kaisha Yakult Honsha, both of Tokyo, all of Japan

[21] Appl. No.: 256,423

[22] PCT Filed: Dec. 22, 1993

[86] PCT No.: PCT/JP93/01852

§ 371 Date: Apr. 14, 1995

§ 102(c) Date: Apr. 14, 1995

[87] PCT Pub. No.: WO95/01281

PCT Pub. Date: Jan. 12, 1995

[30] Foreign Application Priority Data

| | | | |
|---|---|---|---|
| Jun. 30, 1993 | [JP] | Japan | 5-041131 U |
| Nov. 26, 1993 | [JP] | Japan | 5-321070 |
| Nov. 26, 1993 | [JP] | Japan | 5-321071 |

[51] Int. Cl.$^6$ ..... B65H 1/00

[52] U.S. Cl. ..... 221/33; 248/100

[58] Field of Search ..... 221/33, 45, 46, 221/268; 248/95, 99, 100

[56] References Cited

U.S. PATENT DOCUMENTS

| | | | |
|---|---|---|---|
| 5,050,743 | 9/1991 | Lazzalotti | 248/100 |
| 5,310,102 | 5/1994 | Hougham | 248/100 |

FOREIGN PATENT DOCUMENTS

| | | |
|---|---|---|
| 60-134817 | 7/1985 | Japan . |
| 62-125708 | 8/1987 | Japan . |
| 4-31222 | 2/1992 | Japan . |

*Primary Examiner*—Kenneth Noland

*Attorney, Agent, or Firm*—Armstrong, Westerman, Hattori, McLeland & Naughton

[57] ABSTRACT

A storage device for umbrella sacks comprising a device body for storing a number of storage sacks for umbrellas, a movable support member arranged in the device body so as to move vertically in said device body, a foot pedal for lowering the movable support member, and open control levers for opening the storage sacks in connection with the descending motion of the movable support member.

5 Claims, 18 Drawing Sheets

STORAGE DEVICE FOR UMBRELLA SACKS

BACKGROUND OF THE INVENTION

1. Field of the Invention

This invention relates to a storage device for wet umbrellas that automatically wraps an umbrella and places it in sacks and can be used, for example, at an entrance of hotels, shops and department stores, so that when it is raining, wet umbrellas can be adequately wrapped, handled and stored.

2. Description of the Prior Art

When it is raining, synthetic resin sacks (plastic sacks) have traditionally been used to wrap wet umbrellas in order to avoid wetting cloths, floors or goods, while the customers walk around inside hotels, shops or department stores together with their wet umbrellas.

A wide variety of devices, which can open the openings of storage sacks automatically and store umbrellas by just inserting them into the openings, have been proposed to ease the storage operation smoothly. For example, such devices are proposed in Japanese Patent Application No. 60-134817, Japanese Utility Model Publication No. 62-125708 and Japanese Patent Application No. 4-31222.

In the prior art, mentioned above, it is necessary to include means for absorbing negative pressure suction and a number of links and/or cam mechanism in order to provide a means for opening each storage sack for each umbrella, and therefore, constructions of the prior art became difficult and complex.

At the same time, because a vacuum pump or a motor is used, the production cost is expensive. Such devices cannot be used where a power source is not positioned near the installed devices. Besides, power cords are a hindrance and there is a danger of a short circuit when these devices are operated when it is raining.

Furthermore, in the prior art, because a number of storage sacks are simple piled up to fill them in the storage device, it is often difficult to store them and avoid dispersion thereof. In connection with this problem in order to carry or retain such storage sacks, before they are used in the storage device, involves extra labor or other costs.

In consideration of the aforementioned problems, the present invention is proposed to solve such problems and to provide a simple structured device so that umbrellas can easily be placed in storage sacks.

SUMMARY OF THE INVENTION

To attain the aforementioned objects, the storage device of the present invention is comprised of:

a body for filling a number of storage sacks therein;

a movable support member arranged in the device body and movable in vertical directions;

a foot pedal for lowering said movable support member; and open control levers that open the storage sacks in connection with the descending motion of the movable support member.

In the present invention, at first a number of storage sacks are stored in a box and the box is filled in the device's body. The storage sacks are suspended by means of a hanger in order to store such sacks in such box.

In addition, according to the present invention, the open control levers are structured separately so that pair of levers move and rotate independently relative to the movable support member. A means for moving and rotating each open control lever in a direction, in which each of said levers contacts with the storage sacks, is preferably provided separately. In this case, for example, a spring is preferable. Besides, the open control levers can be comprised of bucket-shaped members made with a friction-free material (e.g., resin material such as plastic). The aforementioned device body is not limited by its case. It can be structured by pillars with transparent members arranged between the pillars.

According to the structure of the present invention, when the foot pedal is pressed, the movable support member is lowered and the open control levers open the storage sacks in connection with descending motion of the movable support member. And then, wet umbrellas can be stored in the storage sacks by inserting each umbrella into one of the opened storage sack.

In the present invention, according to the preferred embodiments of the open control levers, in the case where the open control levers are structured separately, a pair of levers move and rotate independently relative to the movable support member, respectively. In the case where the means for moving and rotating each open control lever in a direction in which the open control levers contact with the storage sacks, such moving and rotating means is structured separately and independently from each other, so that the opening can open exactly although misregistration of the opening is generated.

Besides, in case that a number of storage sacks are stored in a box and the box is filled into the device body, or in case that a number of storage sacks are stored in said box by suspending said storage sacks with a hanger, a large number of storage sacks can be easily stored in the device body collectively and rapidly. Additionally, because they are packed in one box, it is easy to carry or store many sacks before they are filled in the storage device. Furthermore, the required costs can be minimized.

In addition, in case that the open control levers are constructed separately and are constructed as a pair of levers moving and rotating independently relate to the movable support member, respectively, and in case that the means are constructed separately and independently relative to each lever, each open control lever moves and rotates in such a direction as make contact with the storage sacks. Since each lever independently moves and rotates to open the storage sacks in connection with the descending motion of the movable support member, and then, the pair of levers enter into the openings of storage sacks to open them, the opening can be opened exactly in despite of any misregistration generated around the opening.

In the present invention, in case that the open control levers are made of bucket-shaped members being made of nonfriction materials, such as, resin material (e.g.) plastic, the insertion of umbrellas can be easier and with greater certainty.

BRIEF DESCRIPTION OF THE DRAWINGS

Preferred embodiments of the present invention will be more fully described in conjunction with reference to the attached drawings, in which.

DETAILED DESCRIPTION OF THE PREFERRED EMBODIMENTS

Figure 1:
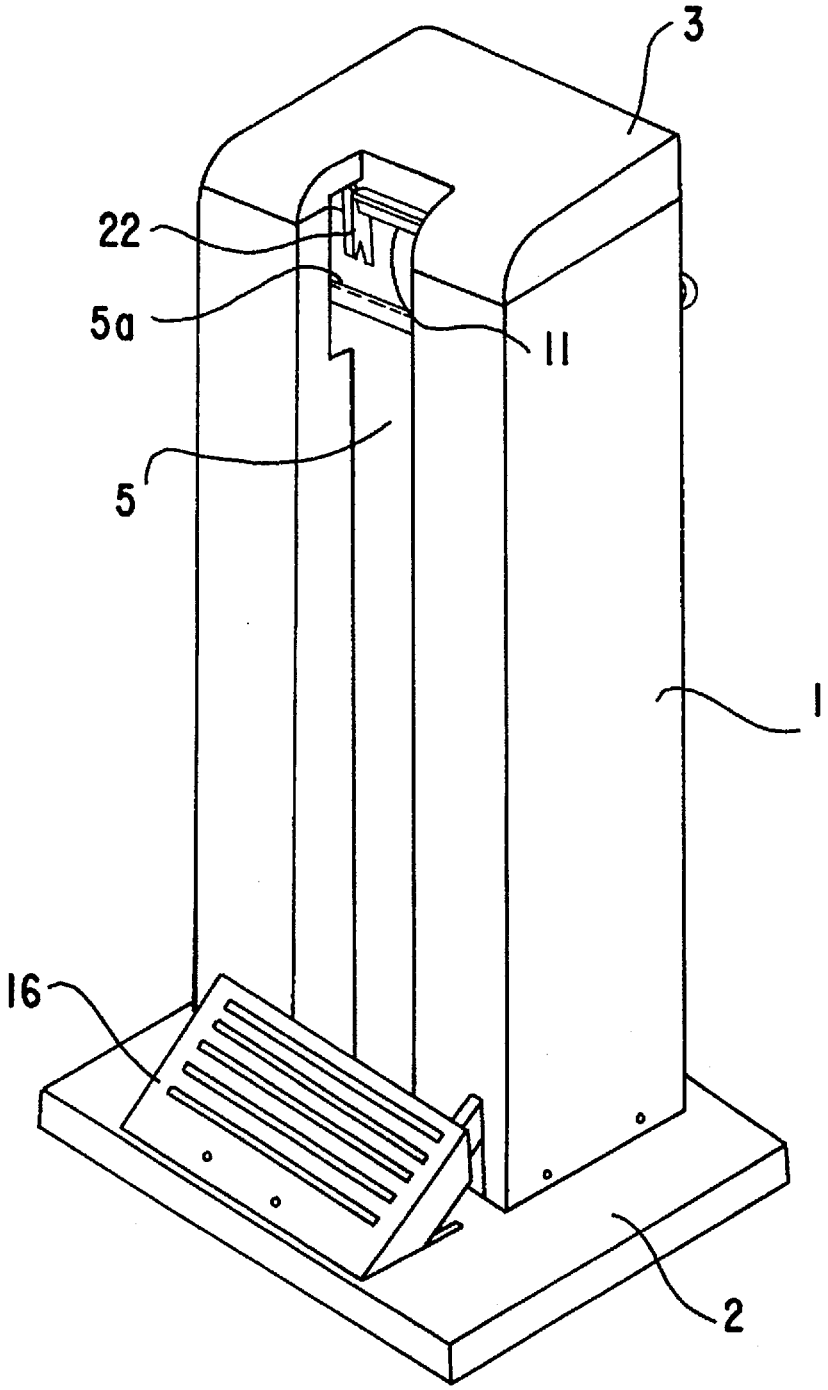
FIG. 1 is a perspective view showing a preferred embodiment of the storage device for umbrellas sacks of the present invention.
Figure 2:
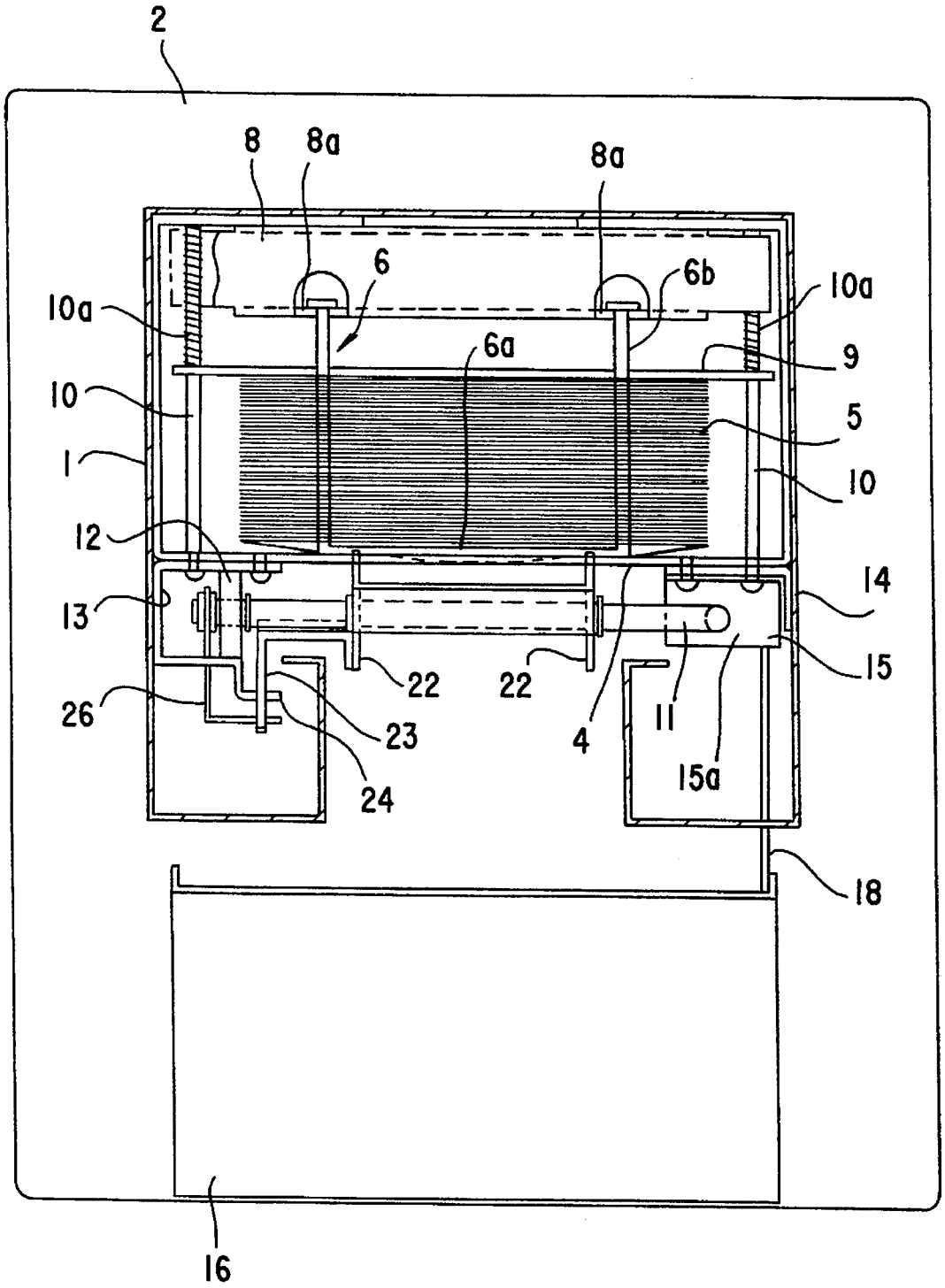
FIG. 2 is an enlarged plan view, with the cover removed and showing the embodiment of FIG. 1.
Figure 3:
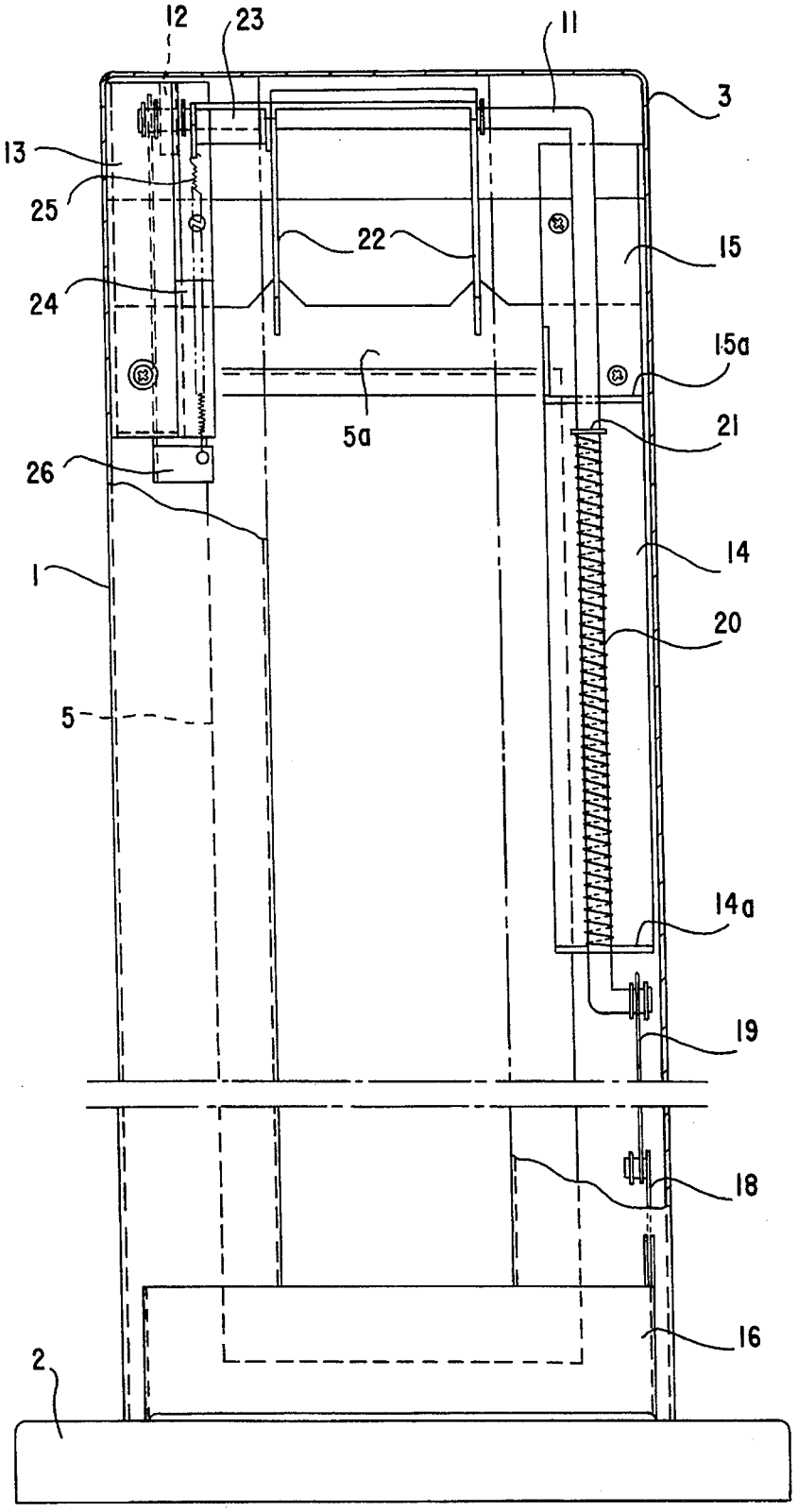
FIG. 3 is a front view, partly in section, of the embodiment shown in FIG. 1.
Figure 4:
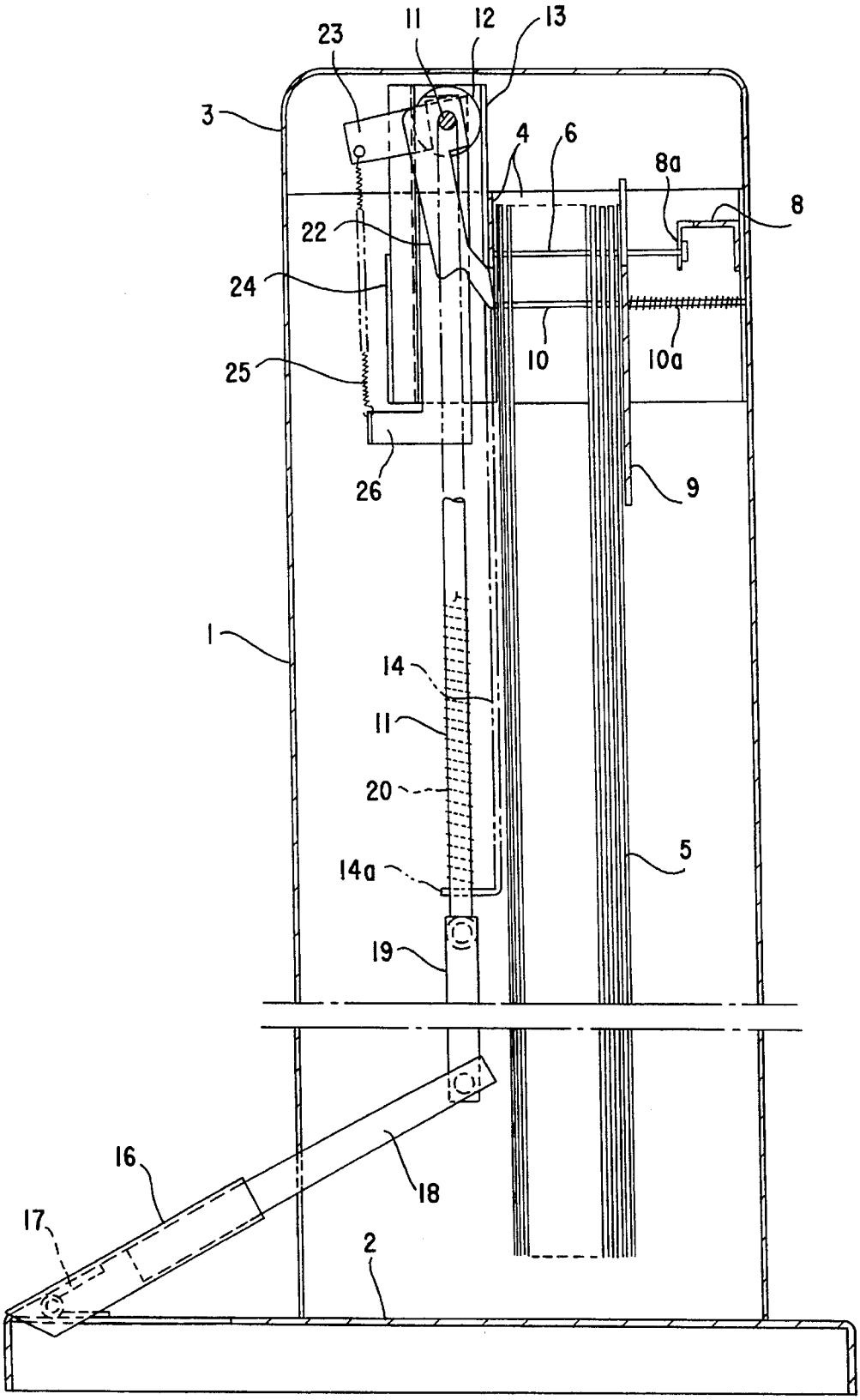
FIG. 4 is a side view of the embodiment shown in FIG. 1.

In the embodiment of FIG. 1 to FIG. 4, 1 is a quadratic prism-shaped device body situated on a bed plate 2 with closing cover 3 is installed on top of the device body 1. As shown in FIG. 2 and FIG. 4, a fixed support base 4 is mounted inside of the upper device body 1 and a hanger 6, which is suspended to retain storage sacks 5, is set on the fixed support base 4.

As shown in FIG. 2, the hanger 6 is comprised of a bar and the like in the form of a box (top-open rectangle-shaped). The base 6*a* is anchored to a hook (not illustrated) and mounted on a fixed support base 4 and the hanger 6 is installed by hitching both ends 6*a*, 6*b* to anchor holes 8*a* of support member 8 fixed to the fixed support base 4 for ease of removal.

Figure 6A:
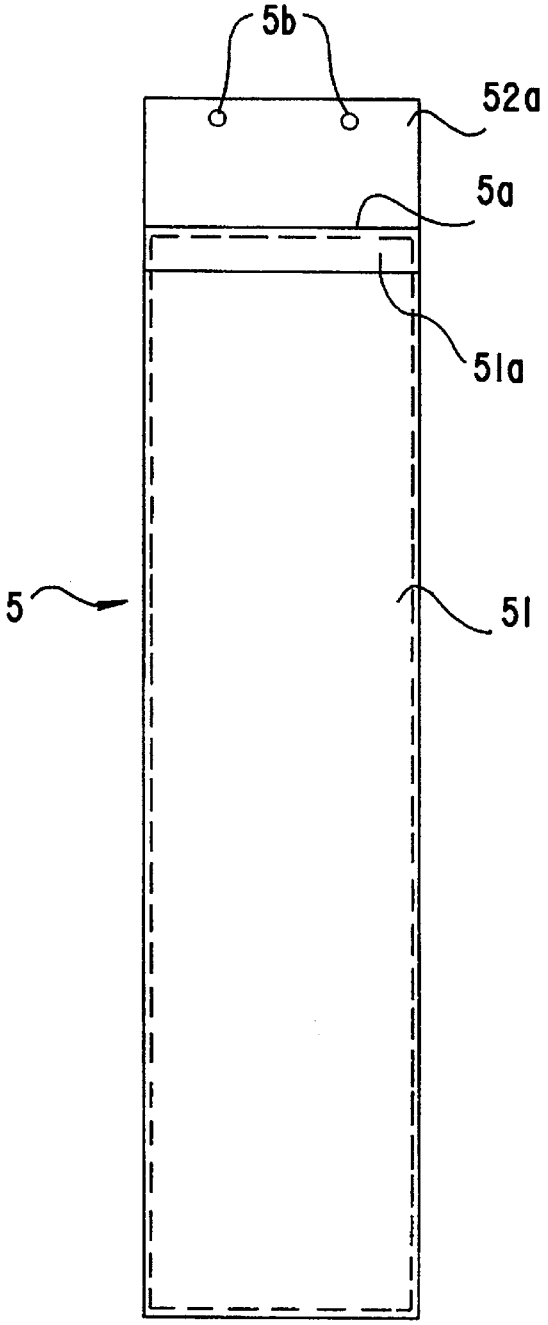
FIGS. 6(A) and 6(B) are a front view and a section view of the storage sack, respectively.
Figure 6B:
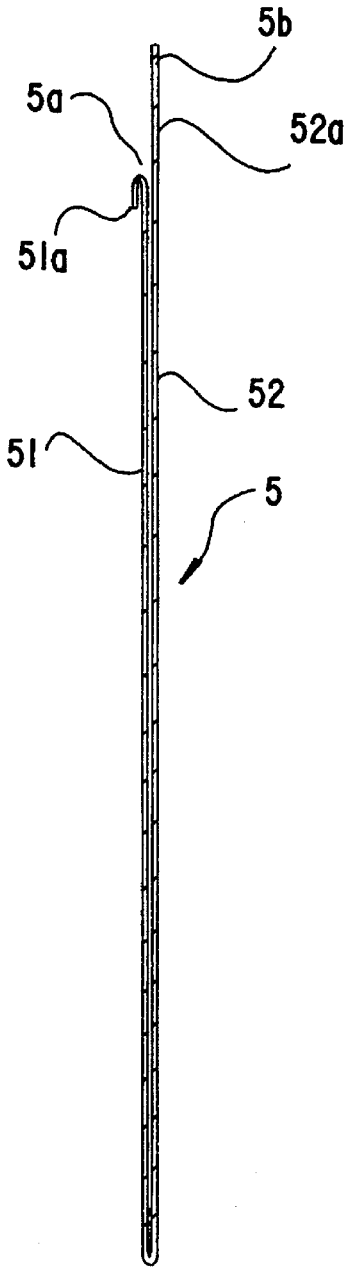

On the other hand, as shown in FIG. 6, the top part of the storage sack 5 has an opening 5*a*. The upper end 51*a* of the fore side 51 of the opening is folded forward in a U-shape. The upper end 52*a* of the rear side 52 is projected above that of the fore side 51 and a pair of locking holes 5*b* are provided at the upper end of the projected portion.

As shown in FIG. 2 and FIG. 4, a number of storage sacks are suspended and are held by inserting the opposing member (opposing arm) into each locking hole 5*b* of the storage sacks. A movable pressure plate 9 is located along a pair of guide bars 10, 10 on the rear face of storage sacks 5 and the pressure plate 9 is constantly pressed against the rear face of storage sacks 5 by a coil spring 10*a* penetrating into each guide bar.

Figure 5:
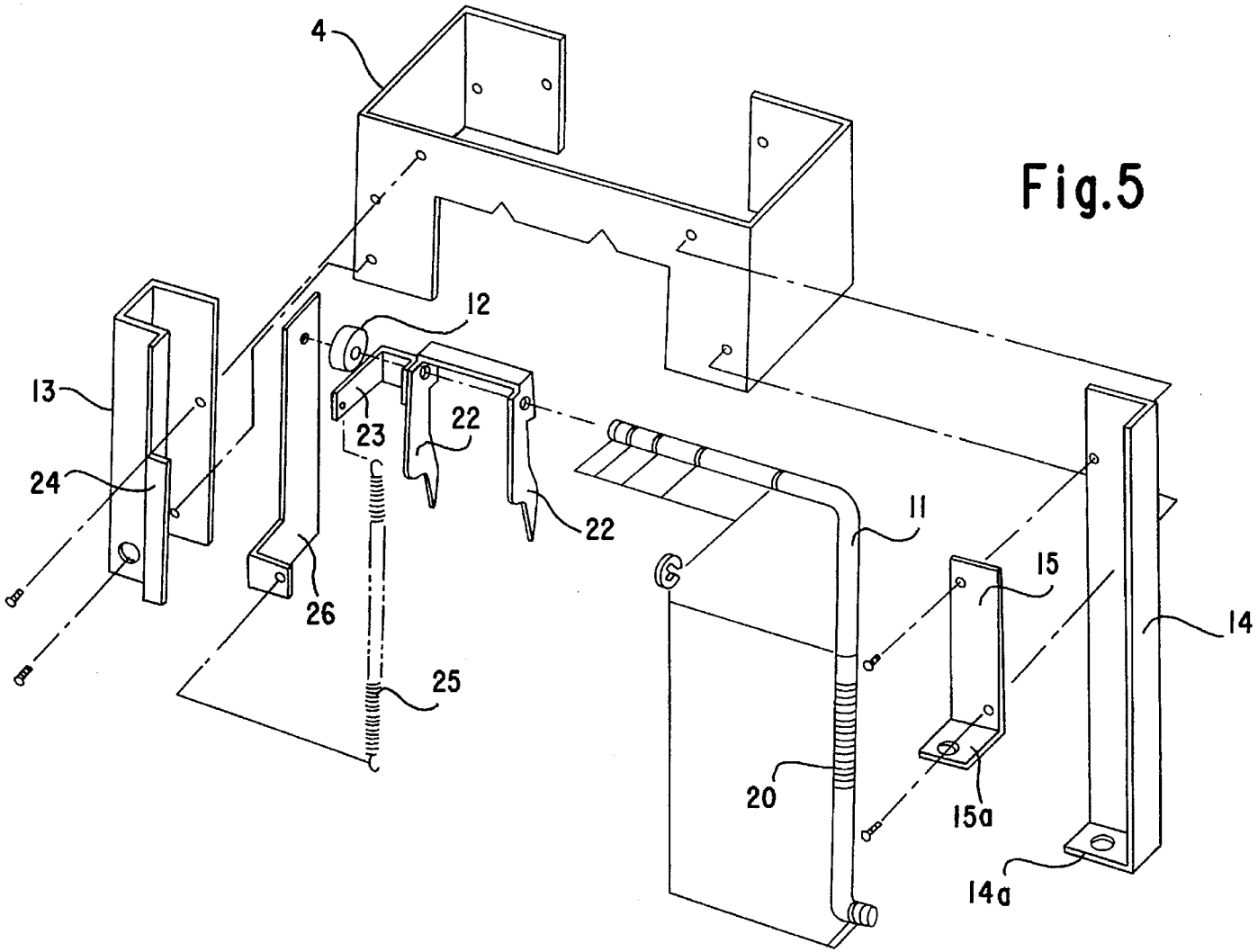
FIG. 5 is an exploded view showing the pivot arrangement.

As shown in FIG. 3 and FIG. 5, guide members 14, 15 are mounted ahead of the fixed support base 4. A movable support member 11 in an inverted L-shape (front view) is penetrated for storage to move vertically in holes 14*b*, 15*b* formed on the horizontal arms 14*a*, 15*a* of such guide members. Besides, a roller 12 is provided at the upper end of the movable support member 11 to rotate freely. The roller 12 is arranged along with a box type guide rail 13 mounted ahead of the fixed support base 4 to move it vertically.

A foot pedal 16 is provided on bed plate 2 to lower movable support member 11. As shown in FIG. 4, the foot pedal 16 is mounted on a hinge 17 to pivot vertically on the bed plate 2. A lever 18 is integrally mounted on the pedal 16 and the lever 18 is connected to the lower end of said movable support member 11 through link 19.

In FIG. 4, the character 20 is a spring for returning movable support member 11. Return spring 20, FIG. 3, is arranged between a spring bearing 21 and a horizontal arm 14*a* of guide member 14 in a contracted condition. Spring bearing 21 is comprised of a clip mounted on movable support member 11.

In addition, a pair of open control levers 22, 22 are rotatably provided on the upper central position of movable support member 11, levers 22, 22 enter into the openings 5*a* of storage sacks 5 and open the openings 5*a*. Both ends of levers 22, 22 are integrally connected in a bottom-open rectangle-shape as illustrated in FIG. 3.

A moving control arm 23, FIG. 3, is integrally provided on one end of levers 22, 22 to rotate levers 22, 22; a contacting plate 24 is provided under the arm 23 integral to guide rail 13; the contacting plate 24 moves to rotate both levers 22, 22 in clockwise direction in FIG. 4 by contacting with arm 23.

Coil spring 25 is set as a tension coil spring between moving control arm 23 and spring bearing 26 connected vertically to one end of the movable support member 11 so it can rotate freely. The lower end of said open control levers 22, 22 move and rotate constantly in a direction toward stored sacks 5. The lower end of open control levers 22, 22 can constantly be moved to rotate in such a direction toward stored sacks 5 by locking one end of a helical spring to the movable support member 11 and the other end of the spring to open control lever 22. In this case, the helical spring, and the like, can be arranged around the movable support member 11 close to open control lever 22, 22.

Figure 7C:
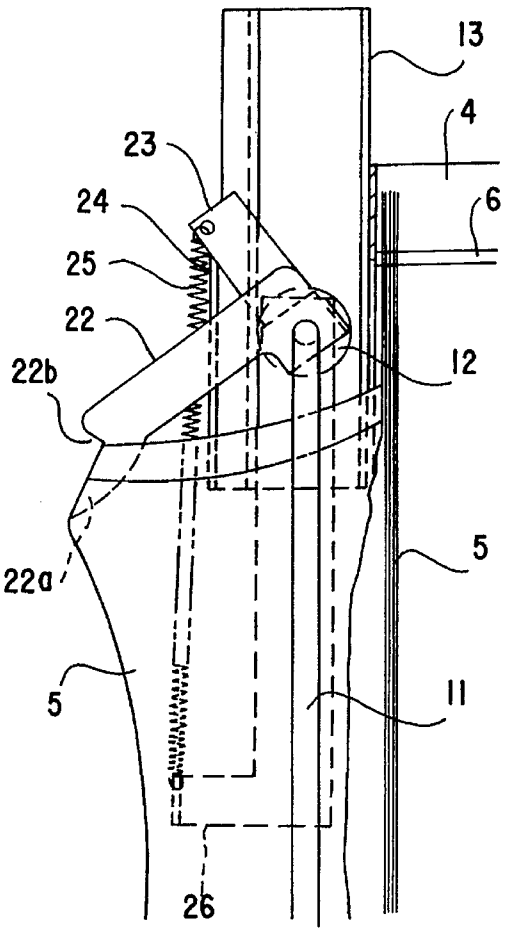
FIGS. 7(A), 7(B) and 7(C) are explanatory drawings of the storing operation.
Figure 7B:
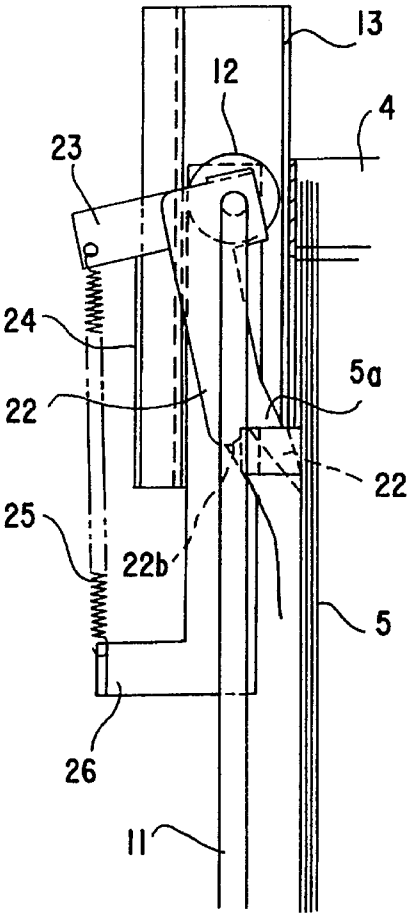
Figure 7A:
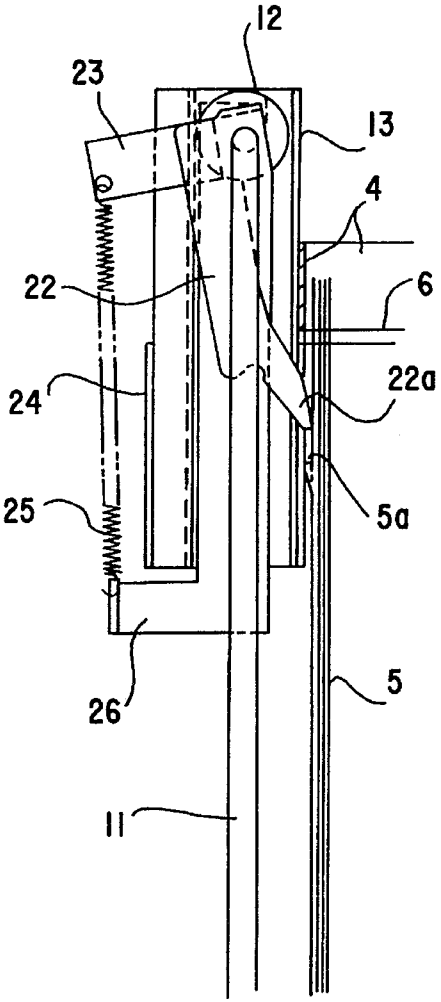

According to the aforementioned structure, as shown in FIG. 7A, the movable support member 11 and the pedal 16 are pushed up by the return spring 20 to the ascending position shown in FIG. 3 and FIG. 4. As result, the lower ends of the open control levers 22, 22 are placed above that of the openings 5*a* of the storage sacks 5.

When the pedal 16 is pushed in the same manner as mentioned above, the movable support member 11 is lowered against the return spring 20. Then, as shown in FIG. 7B, the end 22*a* of the open control lever 22 is entered into the opening 5*a* of storage sack 5. In this case, as illustrated, the end 22*a* of lever 22 can be entered into the opening 5*a* accurately when the upper end 51*a* of the fore side 51 of the opening 5*a* is folded.

In case that the end 22*a* of open control lever 22 is entered into said opening 5*a* to the specified depth, as shown in FIG. 7B, the aforementioned moving control arm 23 will contact the upper end of the contacting plate 24. In the same state, when the open control lever 22 continuously lowers (descends) together with the movable support member 11, each open control lever 22, 22 rotates, in clockwise direction, against the rotating spring 25 around a fulcrum at a contacting point of contacting plate 24 in order to open the opening 5*a* of storage sack 5.

In addition, in the case that a concave area 22*b*, FIG. 7C, is formed close to the end of the open control lever 22 to enter the upper part 51*a* of storage sack 5 into such concave area 22*b*, removing the upper part 51*a* from lever 22 and can be avoided when rotating the open control lever 22.

When the opening 5*a* of storage sack 5 is open, an umbrella can be inserted into the storage sack 5 from between open control levers 22, 22 to wrap and store the umbrella.

The sack 5 in which an umbrella is stored can be removed from the hanger 6, tearing the upper locking holes 5*b* of the storage sack 5 by pulling the sack out and lowering the device body 1. Thus, the sack wrapped umbrellas can easily be removed from the device body 1.

When the foot is released from foot pedal 16 after an umbrella, wrapped in a storage sack, is taken out, the movable support member 11 and the pedal 16 will return by the return spring 20 to the state shown in FIG. 3 and FIG. 4. Simultaneously, the open control lever 22 will be returned by the rotating spring 25 to the state shown in FIG. 7A in a standby state.

As mentioned above, according to the embodiment show in FIG. 1 to FIG. 7, umbrellas can easily be stored into each storage sack completely without using a motor or vacuum pump, and the like, in order to easily and completely open the openings of the storage sacks.

The other embodiment is described with reference to FIG. 8 to FIG. 12. According to the embodiment shown in FIG. 8 to FIG. 12, a number of storage sacks 104 are stored in a box 105 and the box is charged into a device body 101.

Figure 8A:
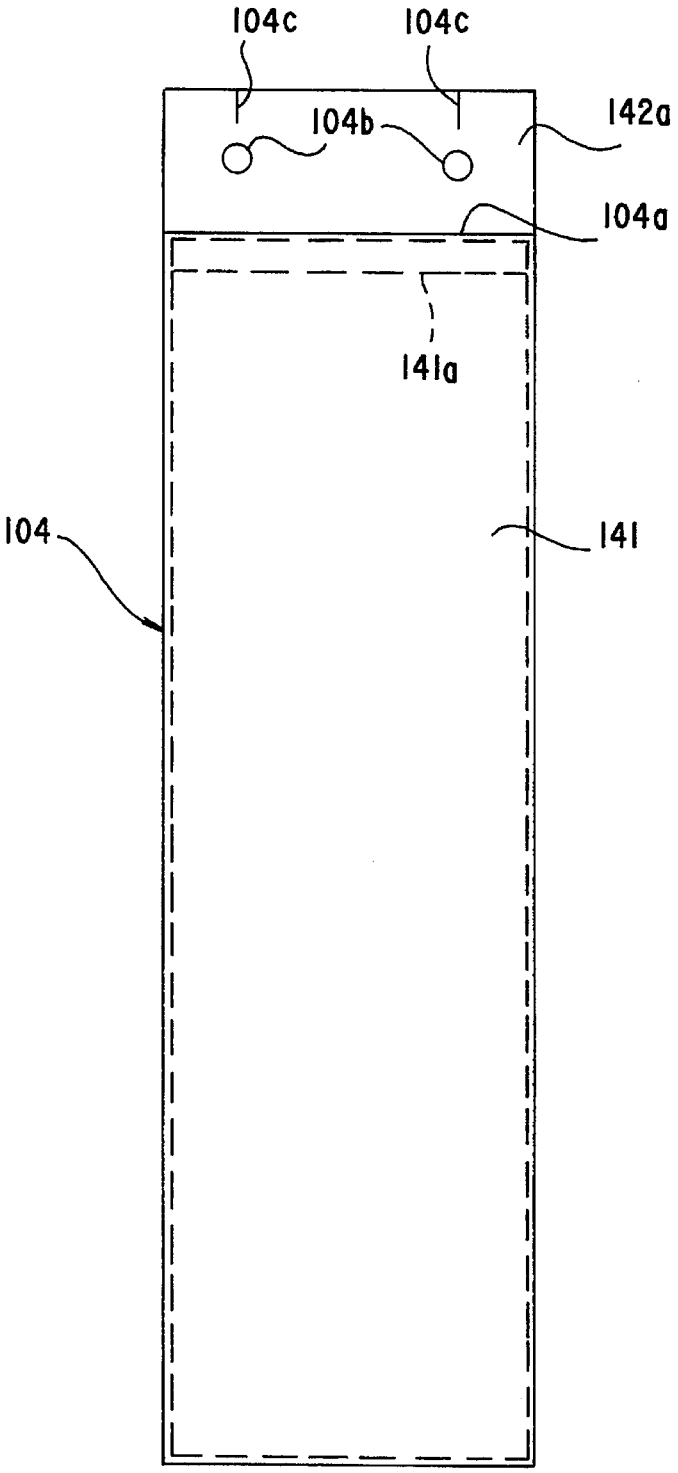
FIGS. 8(A) and 8(B) are a front view and a section view of the storage sack, respectively.
Figure 8B:
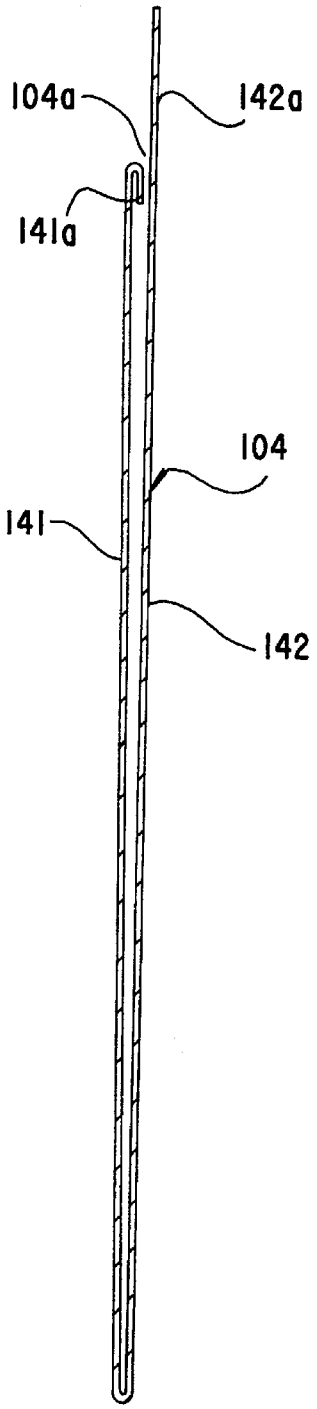

A storage sack, used in the embodiment shown from FIG. 8 through FIG. 12 is shown in FIGS. 8A and 8B. The storage sack 104 comprises a plastic film, and the like, and, as shown in FIG. 8, is formed in a flat cylinder-shape. The upper part of the storage sack has an opening 104*a*; the upper end 141*a* of the fore side 141 at opening 104*a* is folded in a U-shape toward the rear side 142 and the upper end 142*a* of the rear side 142 projects further than that of the fore side 141. A pair of locking holes 104*b* are provided at the upward projected portion.

Figure 9:
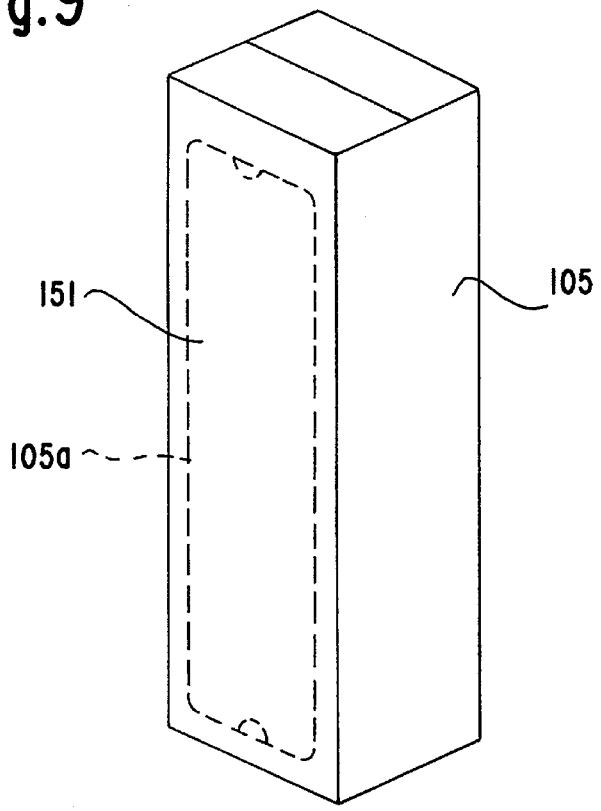
FIG. 9 is a perspective view of a storage box.
Figure 10:
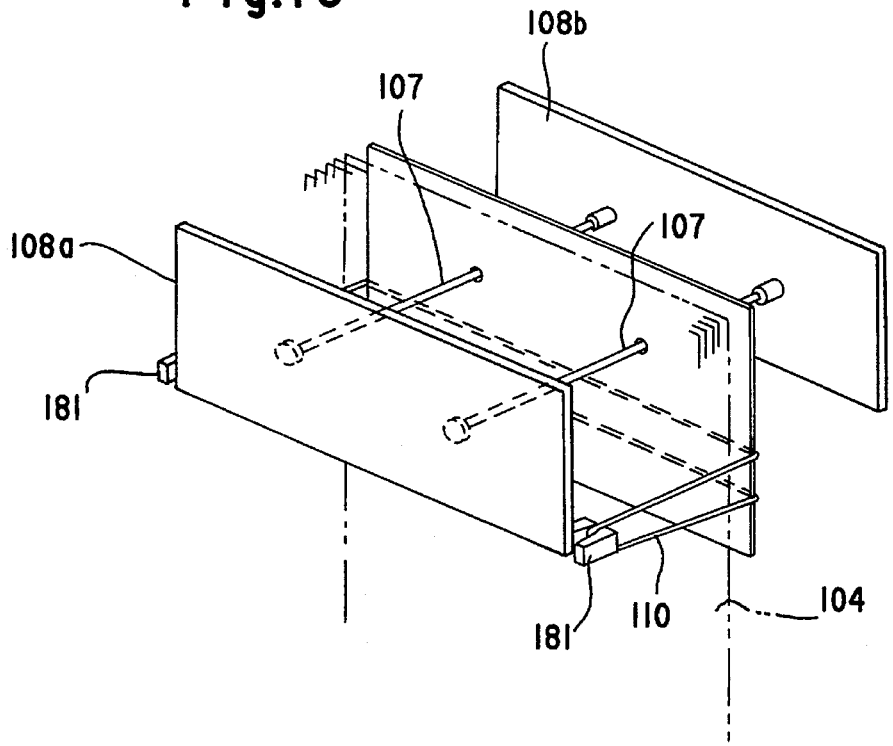
FIG. 10 is a perspective view of the member for suspending the storage sacks and for retaining them in the storage box.

The aforementioned box 105, FIG. 9, is made of corrugated fiberboard and is formed in the shape of a longitudinal rectangular parallel pipe. As shown in FIG. 10, a pair of bar-shaped hangers 107, 107 are provided inside the upper part of said box 105 and said hangers 107, 107 penetrate locking holes 104*b* of the storage sack 104. Hangers 107,107 are attached to support plates 108*a*, 108*b* fixed to the upper surface inside the box 105. Thus, a number of storage sacks 104 can be suspended to retain a state such that the fore side 141 faces the left-hand side, as shown in FIG. 10.

Figure 12:
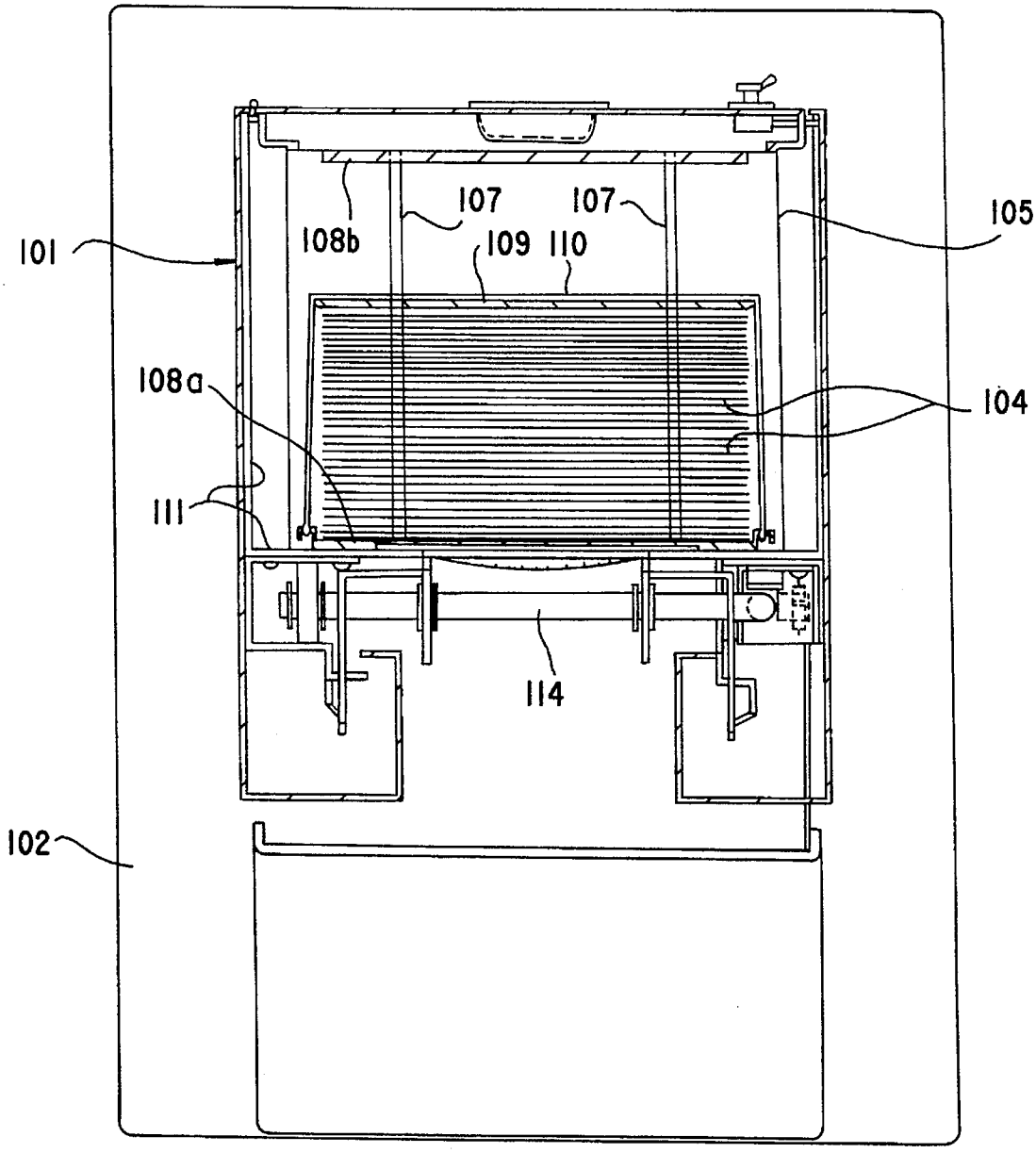
FIG. 12 is a top view, partly in section, of a device body shown in FIG. 11.

A pressure plate, see FIG. 12, is arranged on the rear face of the storage sacks 104 and presses the storage sacks with an elastic member 109. In FIG. 10, rubber bands 110 are applied as the elastic members 109, both ends of the rubber bands 110 are anchored by a hook 181 provided at opposite sides of supporting plate 108*a*.

Figure 11:
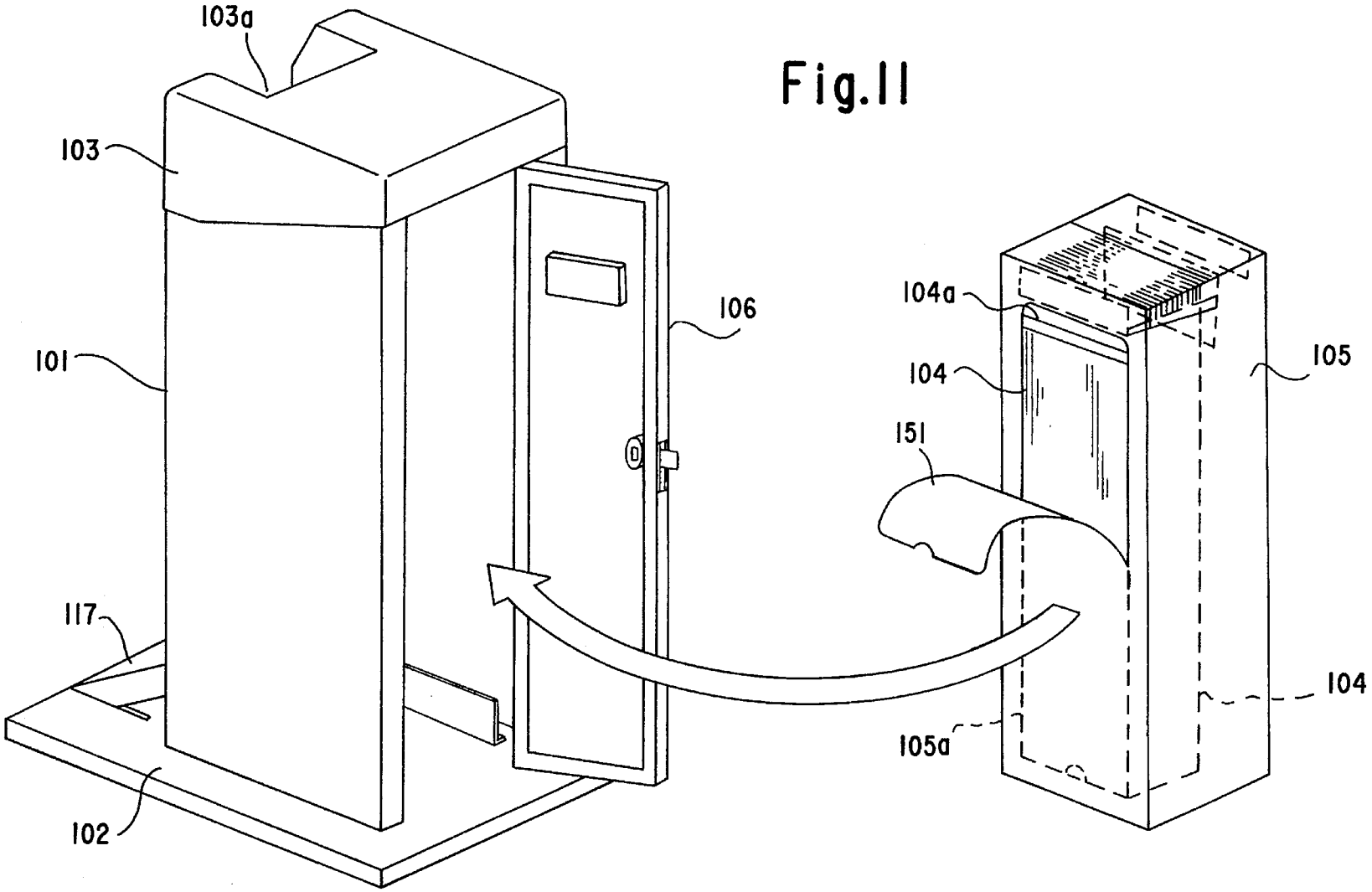
FIG. 11 is a perspective view showing a box being filed in the storage device.

As shown in FIG. 9, an opening 151 which can open along the perforating scores 105*a* is provided on the front face of the box 105. The box 105 or the storage sacks 104 which are stored in the box, are transferred and stored without opening the opening when they are not used. When they are used, as shown in FIG. 11, after the opening 151 is open along with the perforating scores 105*a*, the switch door 106 provided on the rear side of the device body 101 is opened to place the box 105 into the device body 1.

As shown in FIG. 12, a box type fixed support member is integrally provided inside the device body 101 on the upper part of the box 105 placed in the device body positioned so as to contact the fore side of the fixed support member 111 with the front face of box 105.

According to the aforementioned embodiment shown in FIG. 8 through FIG. 12, the box 105, storing storage sacks for umbrellas is filled from the rear side to the device body 101. However, the box can be filled from the top of the device body 101 by configuring, for example, a cover 103 which can be opened.

Figure 13:
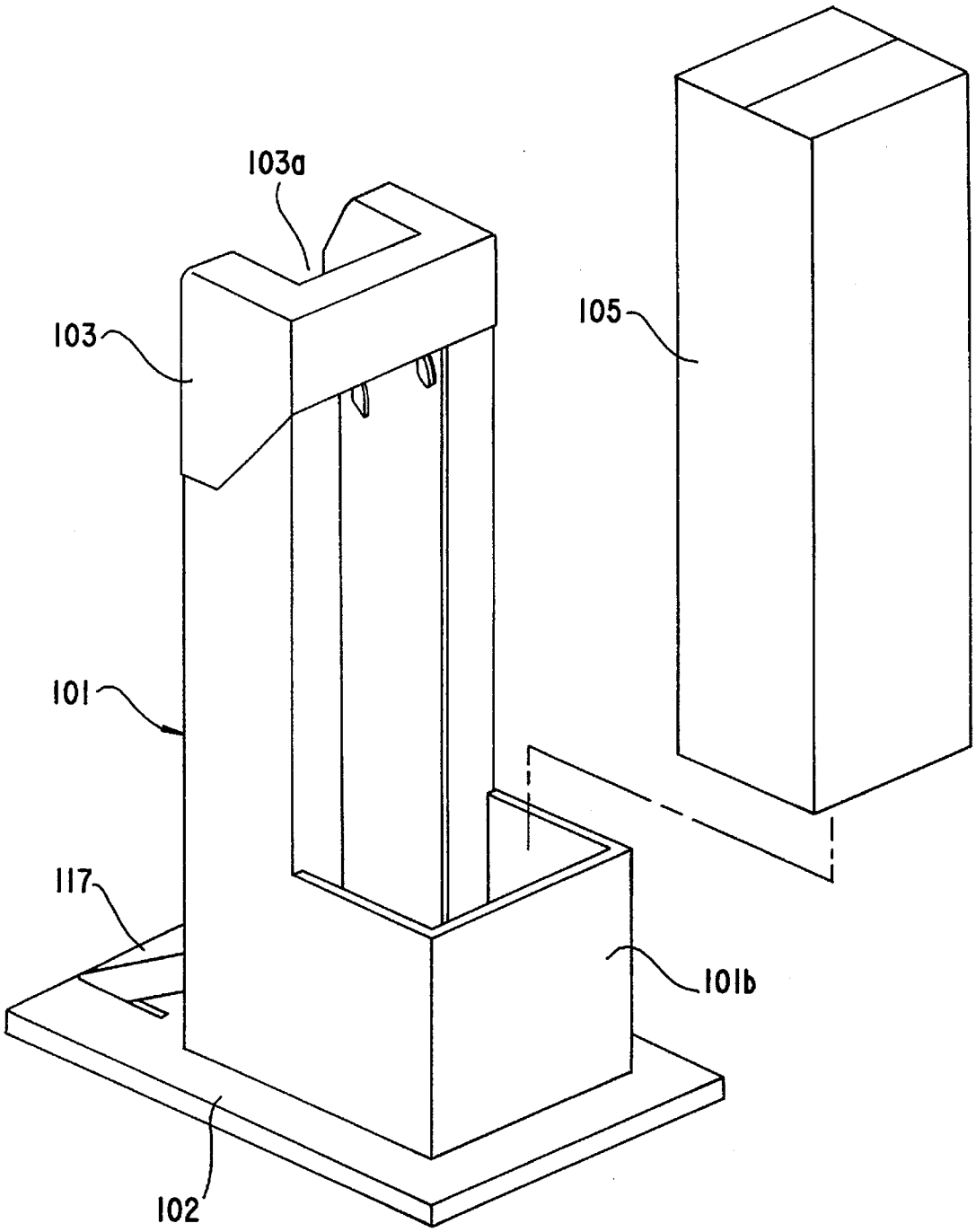
FIG. 13 is a perspective view of an embodiment different from the embodiment shown in FIG. 8 to FIG. 12.

In addition, as shown in FIG. 13, a frame body 101*b* can be applied as part of the device body to place the box 105 in the frame 101*b* to determine the specified position to retain the box without covering up all faces of the box 105 by the device body 101. Besides, the opening 4*a* of the storage sack 4 can be opened by actuating vacuum suction in the aforementioned prior embodiment without using the open control lever 22 to open the opening 4*a* in accordance with the embodiment shown in FIG. 1 to FIG. 7.

Figure 14:
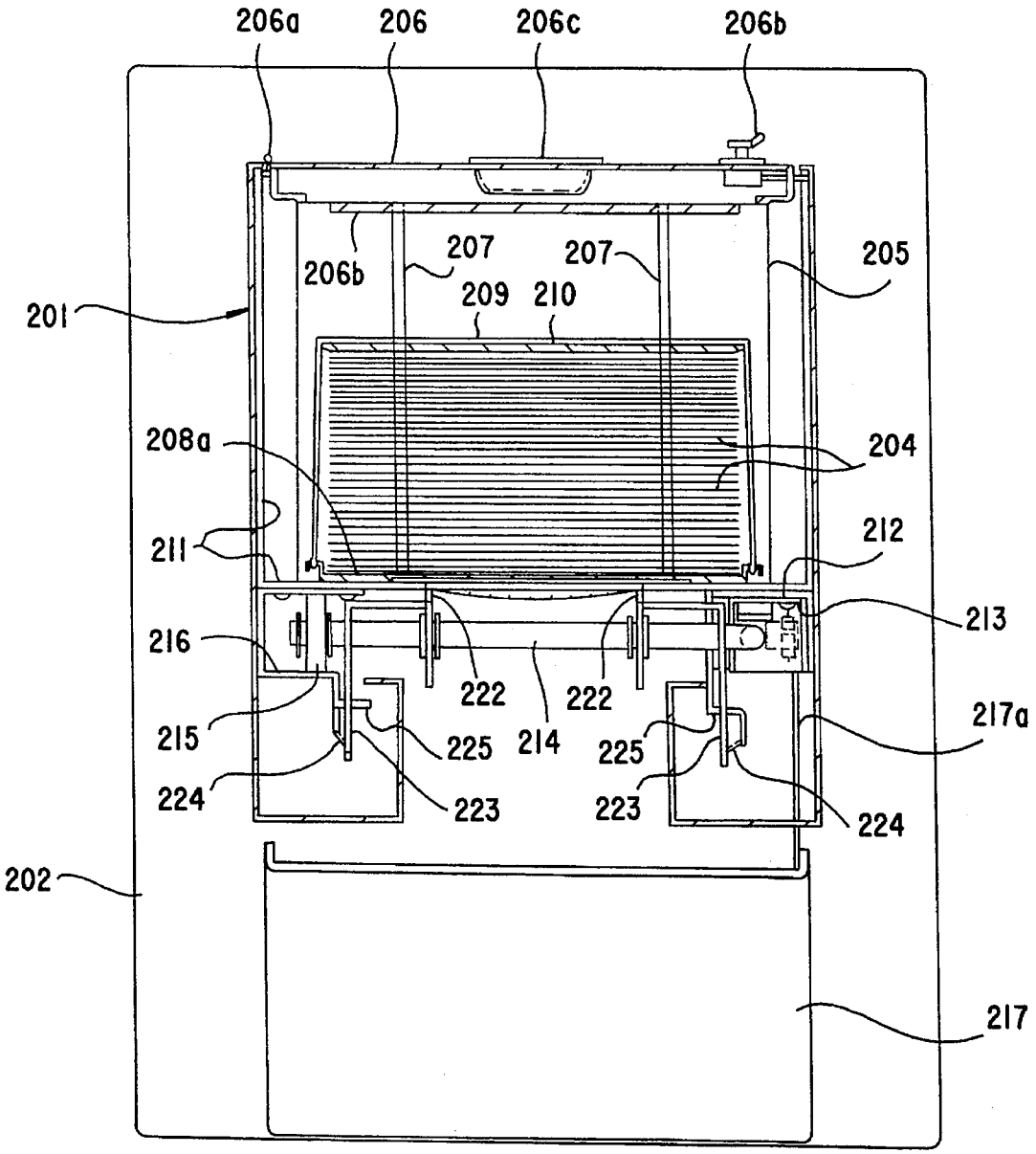
FIG. 14 is a top sectional view of the embodiment of FIG. 13.
Figure 15:
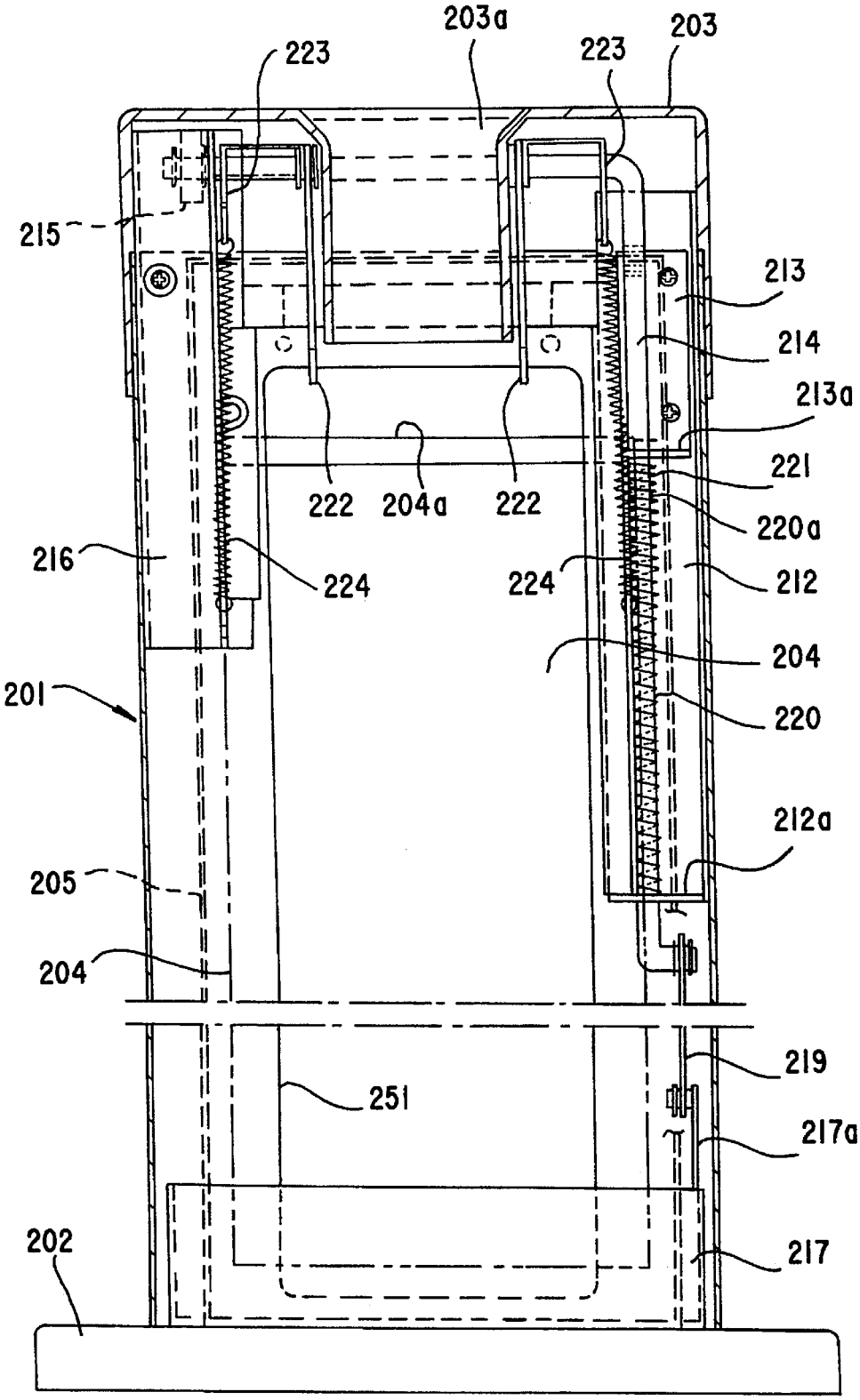
FIG. 15 is a front view, partly in section, of the embodiment shown in FIG. 14.
Figure 16:
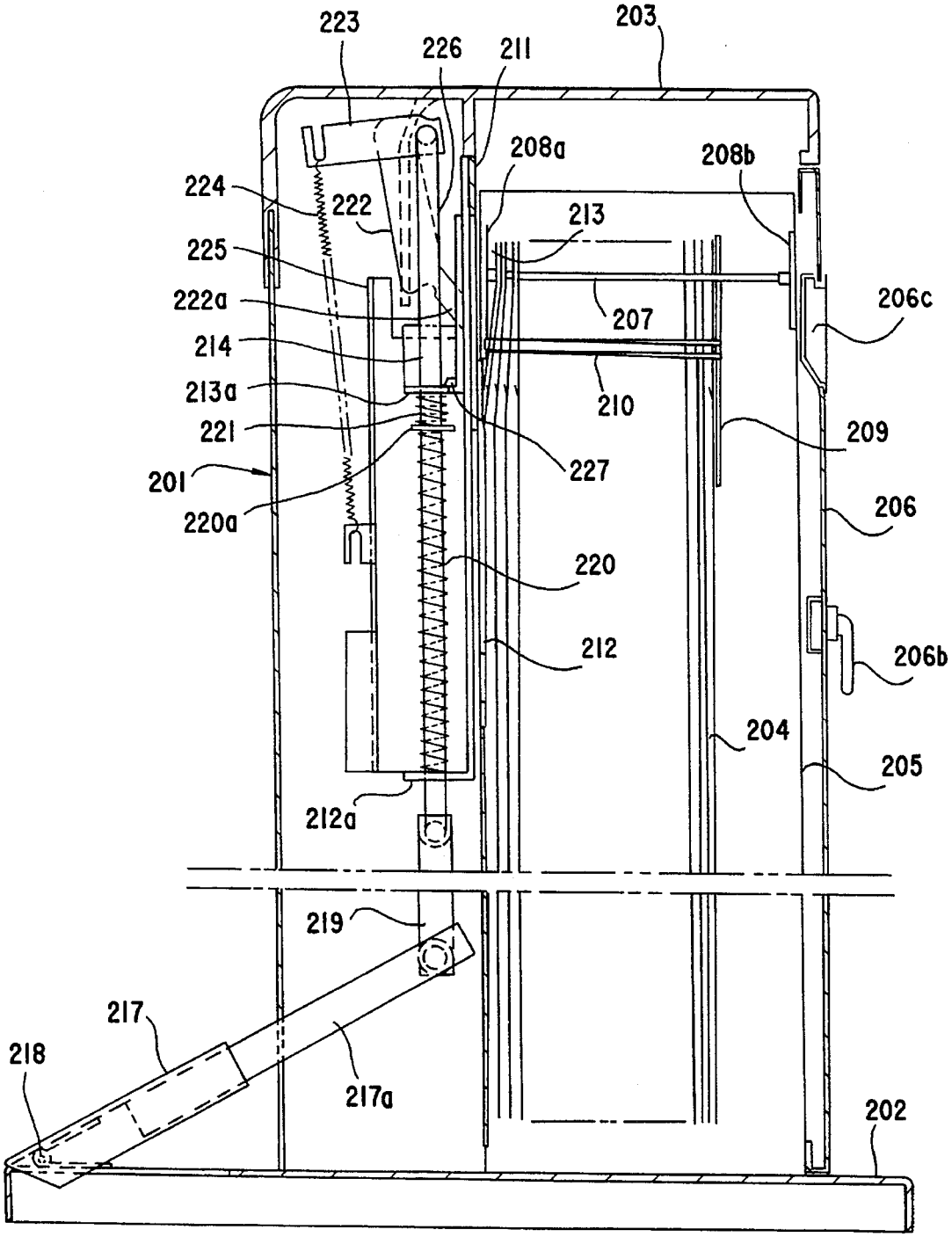
FIG. 16 is a side view, partly in section, of FIG. 13 and FIG. 14.

The following explains another embodiment in the present invention, referring to FIG. 14 through FIG. 16. According to this embodiment, a pair of horizontal open control levers are structured to move and rotate independently.

In FIGS. 14 and 15, a left-hand side tension coil spring 224 is applied between a left-hand side rotation control arm 223 and guide rail 216. A right-hand side tension coil spring is applied between a right-hand rotation control arm 223 and guide member 212. As shown in FIGS. 14 and 16, contacting plates 225, 255 are integrally provided on guide rail 216 and guide member 212. Contacting plates 225, 255 make each open control lever 222 rotate in the reverse direction toward a storage sack 4 by contacting with the rotation control arm 223 when each open control lever 222 moves lower with movable support member 214.

Tension coil spring is exemplified as a means of making each open control lever 22, 222 rotate toward storage sacks 204. However, for example, a helical spring can be applied as such means.

With regard to a mechanism for opening storage sacks 204, such mechanism is substantially the same as in FIG. 7 and further explanations are not deemed necessary. According to the embodiment shown in FIGS. 14 to 16, when the foot pedal 217 is depressed and the movable support member 214 is lowered against a return spring 220, through a link 219, each open control lever 222 separately moves and rotates independently to the movable support member 214. Simultaneously, since springs 224, which move and rotate in the direction to press the open control levers 22, 222 toward the storage sacks, are separately applied horizontally, each open control lever 222 can be inserted into the opening 204*a* by lowering to contact the front face of upper rear end 242*a* of the forefront storage sack 204 even when some longitudinal misregistration of the opening 204*a* in a direction across from the forefront storage sack 204 is generated.

In the aforementioned embodiment, foot pedal is continuously pressed until an umbrella stored in a storage sack is removed from the device body. When the foot pedal is released, after the storage sack is taken out, the original condition will return by working a return spring to ascend the movable support member.

The forefront storage sack can be maintained opened by applying anchoring means to keep lowering the movable support member by depressing the foot pedal until the stored umbrella is taken out when the foot pedal is released. For example, as shown in FIG. 16, a plurality of locking grooves 226 can be formed on the movable support member 214 and an anchoring claw 227, which engages such grooves, can be integrally applied to the guide member 213.

Figure 17:
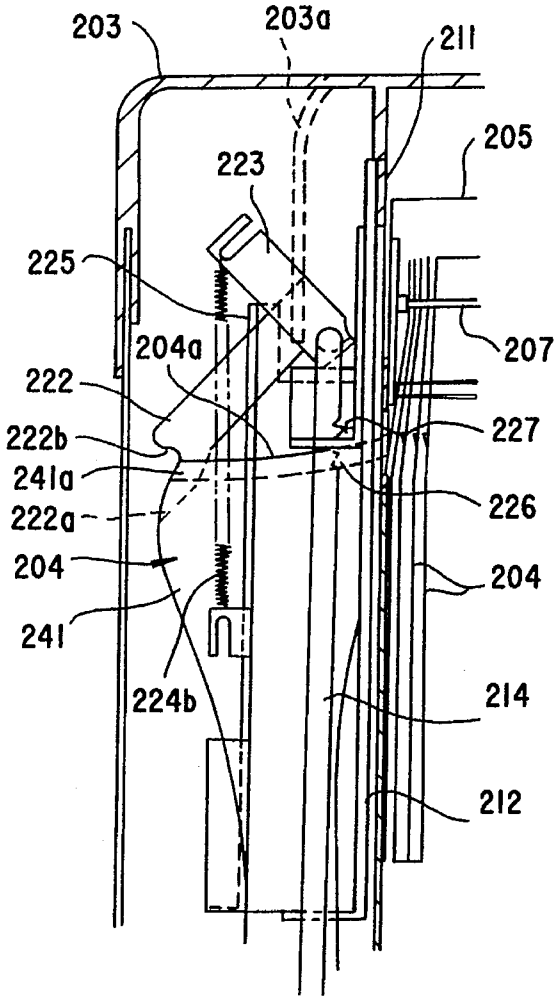
FIG. 17 is a partial side view showing a state of anchoring.

In this structure, when a foot pedal 217 is depressed to lower the movable support member 214, a locking groove 214*a*, formed on the movable support member 214, will hitch to the anchoring claw 227 inclining the movable support member 214 to the anchoring claw 227. As a result, the opening 204*a* of the storage sack 204 is kept open by blocking the ascending motion of the movable support member 14 by the return spring 20, FIG. 17.

When an umbrella stored in a storage sack 204 opens the opening 204*a* and the umbrella, with a sack is removed from the device body, the movable support member 214 will incline in the direction to release the anchoring to an anchoring claw 227 through the open control lever 222. Next, the anchoring locking groove 214*a*, to anchoring claw 227, is released and the movable support member 214 automatically returns to the original position by elastic rebound of the return spring 220.

Figure 18A:
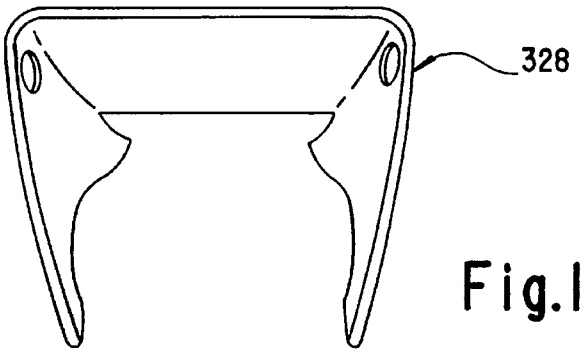
FIGS. 18(A) and 18(B) are a plan view and a side view of a bucket-shaped member, respectively.
Figure 18B:
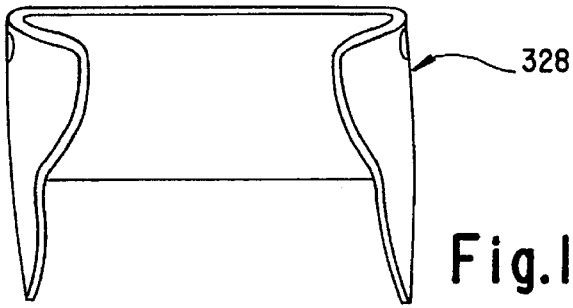
Figure 19:
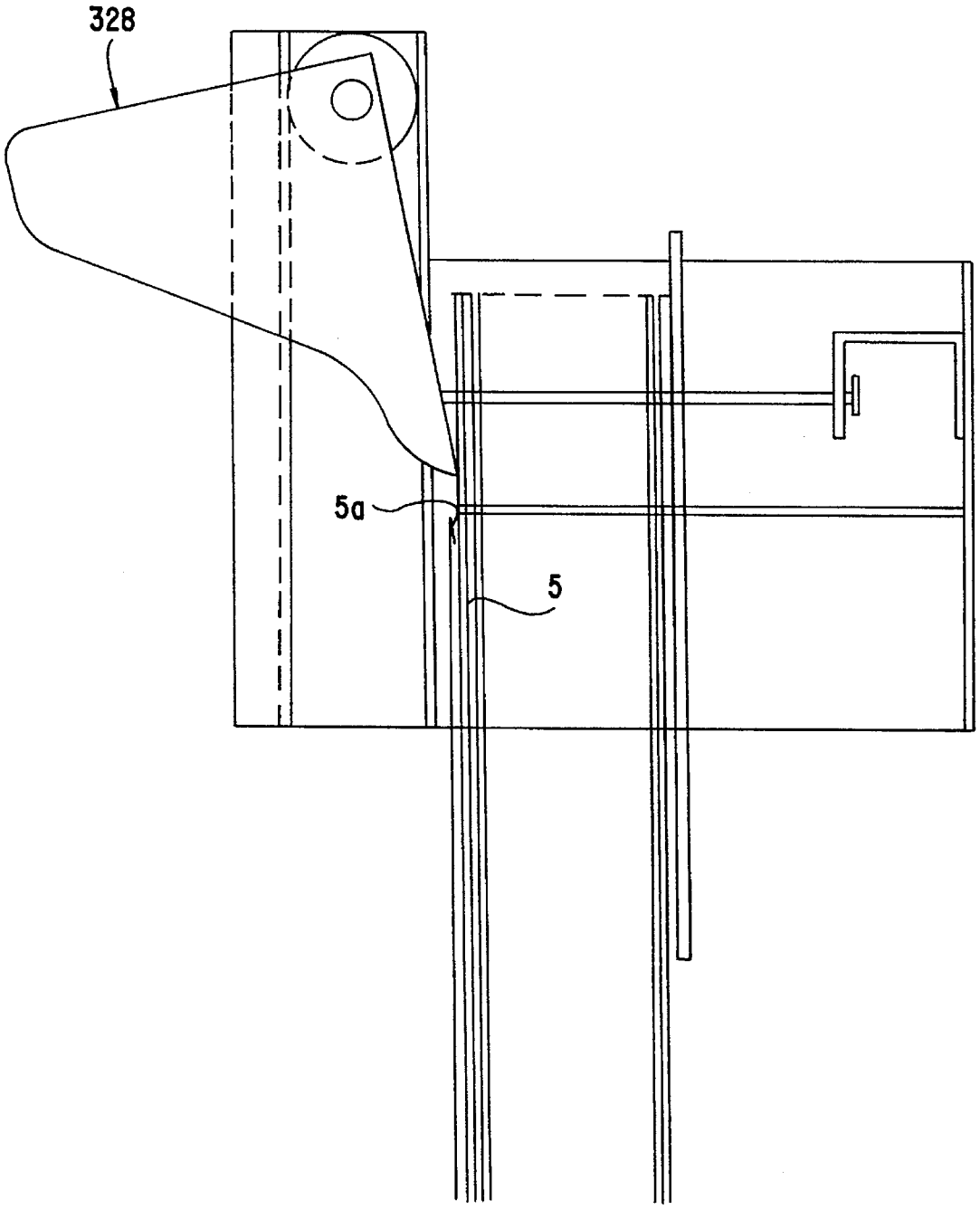
FIG. 19 and FIG. 20 are explanatory drawings showing different phases of the storing process.
Figure 20:
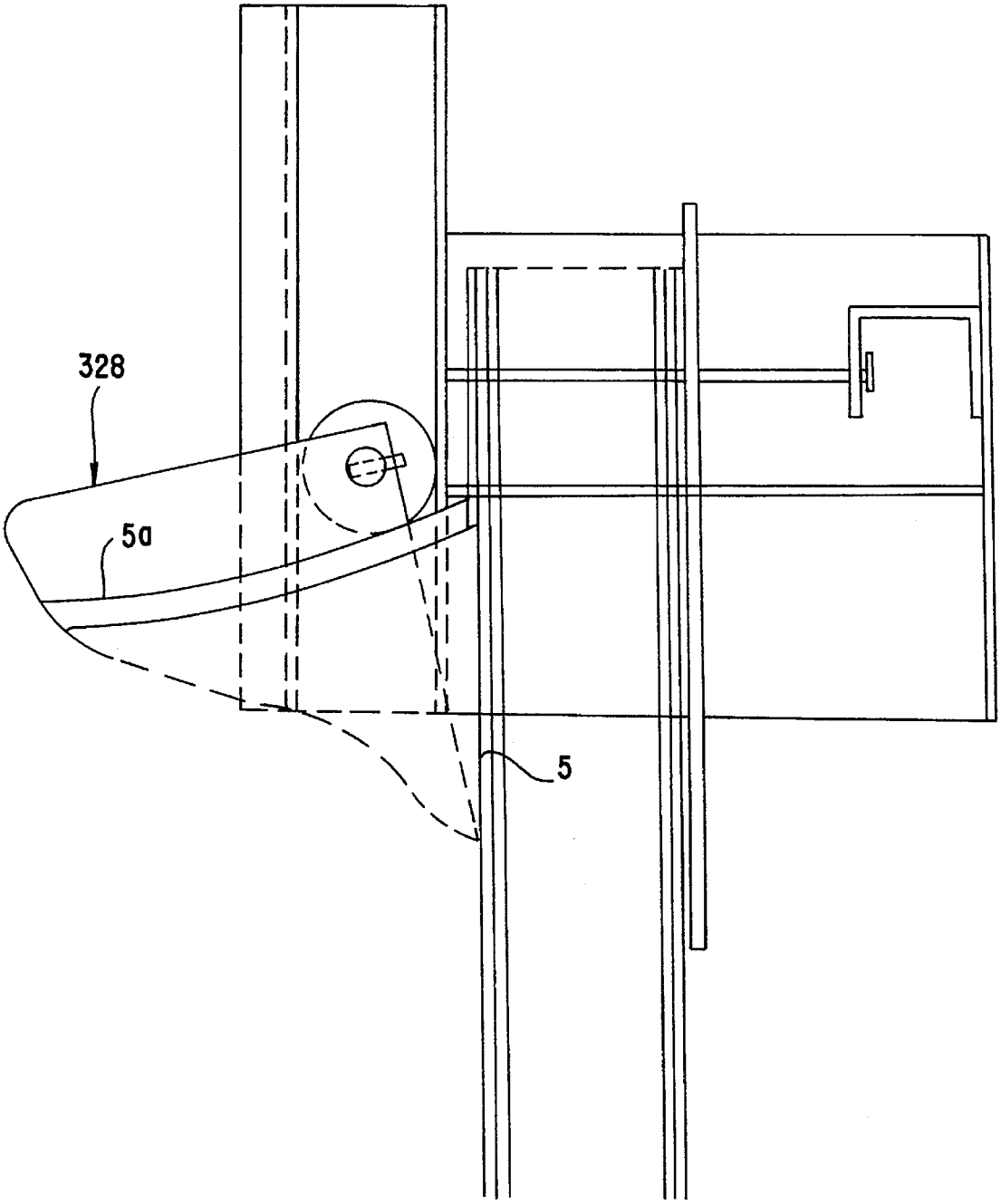

FIGS. 18 to 20 show the other embodiment of the present invention. In FIGS. 18A and 18B, a bucket-shaped member 328, is integrally formed from plastic. Umbrella insertion can be done easily, and completely, due to the shape of this bucket-shaped member 328. Open storage sacks 5, with bucket-shaped member 328, are shown in FIGS. 19 and 20. However, a detailed explanation is not deemed necessary because of the similarity shown in FIG. 19 and FIG. 20 to that in FIGS. 7A, 7B and 7C. Furthermore, the aforementioned embodiment is just an example, therefore structural changes are possible within the purpose of the present invention form time to time.

What is claimed:

1. A storage device for umbrella sacks comprising: a device body having a plurality of storage sacks for umbrellas stored therein; a movable support member in said device body vertically movable therein; a foot pedal for moving said movable support member lower in said device body; open control levers for opening said storage sacks in connection with the descending motion of said movable support member.

2. A storage device for umbrella sacks according to claim 1, wherein a number of storage sacks are firstly stored in a storage box, and said storage box is placed in said device body.

3. A storage device for umbrellas sacks according to claim 2, wherein said large number of storage sacks are suspended by a hanger in said storage box.

4. A storage device for umbrella sacks according to claim 1, 2 or 3, wherein a pair of open control levers are separately provided to move and rotate independently against said movable support member; and means for rotating each of said open control levers to a direction, in which direction each of said levers contacts with said storage sack.

5. A storage device for umbrella sacks according to claims 1, 2 or 3, wherein said open control levers are comprised of bucket-shaped members being formed integrally.

* * * * *